United States Patent [19]

Edler et al.

[11] Patent Number: 4,754,967

[45] Date of Patent: Jul. 5, 1988

[54] SUPPLEMENTAL DEVICE FOR AN AUTOMATIC PIN HANDLING DEVICE

[76] Inventors: Tomas Edler, Stadingeplan 18, S-16363 Spanga; Hans Tarenius, Jarnvagsgatan 3, S-57100 Nassjo, both of Sweden

[21] Appl. No.: 888,069

[22] Filed: Jul. 22, 1986

[51] Int. Cl.[4] ..... A63D 5/08

[52] U.S. Cl. ..... 273/43 A; 273/43 D; 273/54 C

[58] Field of Search ..... 273/43 R, 43 A, 43 D, 273/43 E, 54 C, 54 D

[56] References Cited

U.S. PATENT DOCUMENTS

| | | | |
|---|---|---|---|
| 3,094,327 | 6/1963 | Whang . | |
| 3,123,356 | 3/1964 | Moreland . | |
| 3,138,378 | 6/1964 | Krollman . | |
| 3,153,538 | 10/1964 | Rogers . | |
| 3,219,345 | 11/1965 | Rogers . | |
| 3,235,257 | 2/1966 | Rogers . | |
| 3,314,678 | 4/1967 | Conklin et al. . | |
| 3,497,219 | 2/1970 | Barry et al. . | |
| 3,499,648 | 3/1970 | Huck et al. . | |
| 4,133,042 | 1/1979 | Wallace | 273/54 C |
| 4,302,010 | 11/1981 | Kaenel | 273/54 C |

*Primary Examiner*—Maryann Lastova

*Attorney, Agent, or Firm*—Young & Thompson

[57] ABSTRACT

A supplemental device for use with an automatic pin setting machine permits a player to practice on any desired spare combinations of fewer than ten pins. A control panel is mounted at the player's end of the alley, and this panel has ten keys arranged in the pattern in which the pins are set on the bowling lane. The player selects his spare combination by pushing the appropriate buttons. A control apparatus operates responsive to the player's selection to block delivery of the pins not selected to the pin-receiving magazine, and to simulate delivery of these non-selected pins to the magazine. The pin setting combination selected by the player is immediately stored in a first memory, and is transferred to a second memory for control of the pin-setting apparatus only after the pin-setting apparatus has completed its current operating cycle. In this manner, the player may program his desired pin-setting combination at any time during the course of an operation cycle of the pin-setting apparatus, but the pin-setting apparatus will act on his selection only when it is able to correctly do so.

10 Claims, 6 Drawing Sheets

SUPPLEMENTAL DEVICE FOR AN AUTOMATIC PIN HANDLING DEVICE

Figure 1:
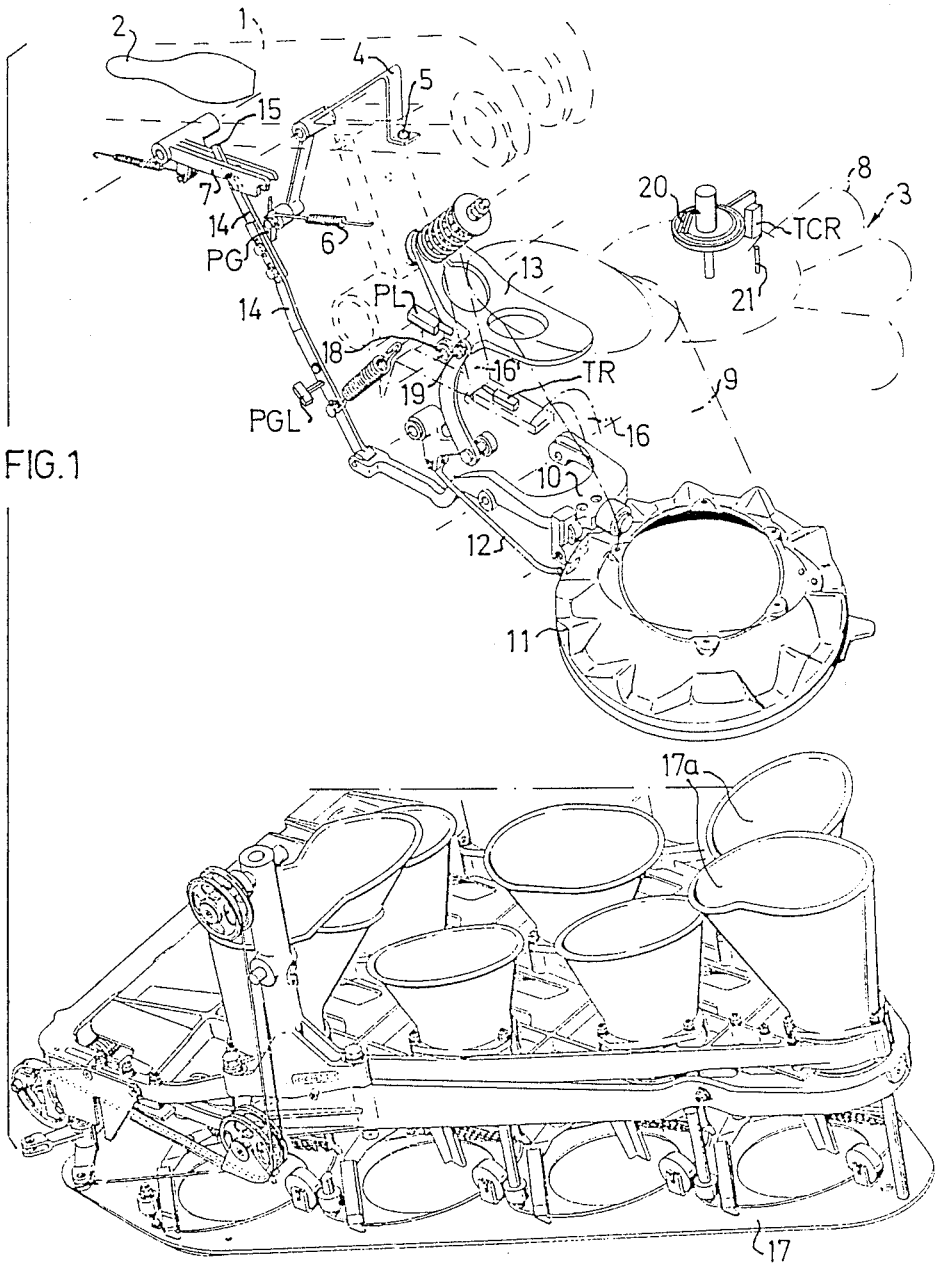

This invention relates to a supplemental device for an automatic pin handling machine for selectively setting chosen combinations of pin settings.

In a bowling game the player is intended to knock down ten bowling pins placed in a predetermined pattern in two attempts. If the player succeeds in knocking down all the pins at the first attempt, this is called a "strike". If the player succeeds in knocking down all the pins in two attempts, this is called a "spare". The player gets bonus points when succeeding in making a "strike" or a "spare".

There are 1,022 theoretically possible pin settings for remaining pins after a first ball attempt 250 of these are usual in practice, the others are unusual or impossible. Good players know how to achieve a spare. The best way to become a good player is to train on certain pin settings of fewer than ten pins, so called spare settings. This training was easy to accomplish when the pins were set manually. Manual pin setting, however, is too costy nowadays and has been replaced by automatic pin setting machines.

Systems to set preselected pin settings as a supplement to an automatic pin setting machine have been proposed earlier. A system in which a player can select a pin setting having fewer than ten pins at a panel is described by Rogers in for instance the U.S. Pat. No. 3,153,538. A control circuit blocks pins not selected in the pin setting to be delivered to the pin magazine (the turret) and simulates also delivery of the non-selected pins to the magazine. A problem inherent with this prior system is that it tends to cause mixed settings at pin setting changes. A solution to this problem is described and illustrated by Conklin et al in the U.S. Pat. No. 3,314,678. According to this solution the panel is normally blocked in order to prevent operation of buttons for pin setting. When the player wants to have a pin setting with fewer than ten pins for spare training, he first depresses a so-called "clear button" and then he has to wait until the machine has emptied the turret until the blocking of the panel is released in order to be able to operate the pin setting buttons. This waiting is quite irritating and demands that the player has a knowledge of the operation of the machine in order to instruct it correctly. The machine described by Conklin et al also has a totally different control system in that a control of each scissor in the scissors deck is made. This requires a very extensive cabling between the panel and the working part of the machine, which is costly and runs the risk of being damaged.

The purpose of the invention is to provide a pin setting apparatus for spare training which is easy to operate by the player and gives him the opportunity to select a desired pin setting simply by pressing buttons, without having to wait predetermined times between different operation steps.

Another purpose of the invention is to provide a spare training supplemental device which is easy to mount on existing machines and which is relatively cheap, has few operating parts and is reliable without causing pin jams.

Figure 2:
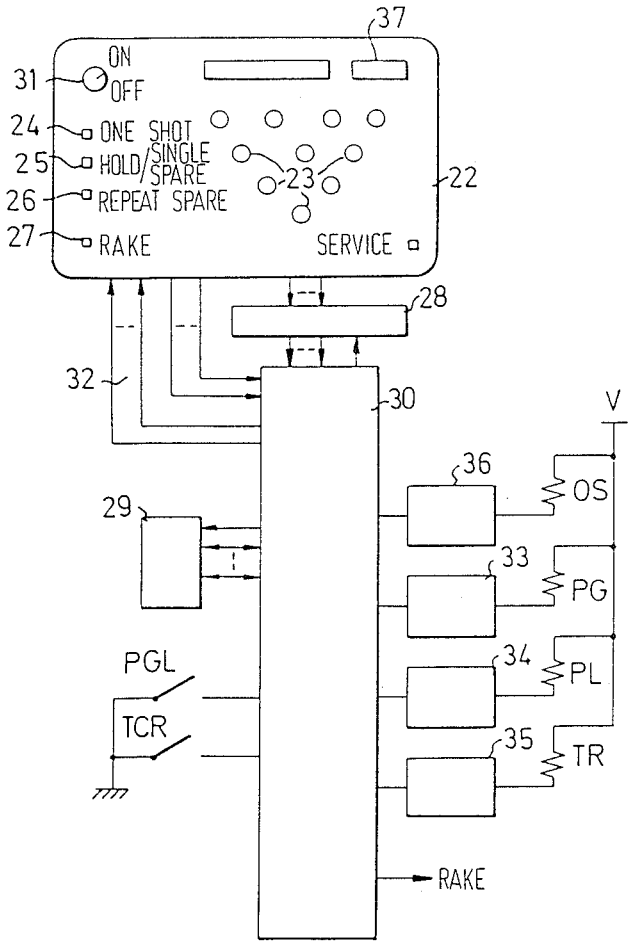
Figure 5:
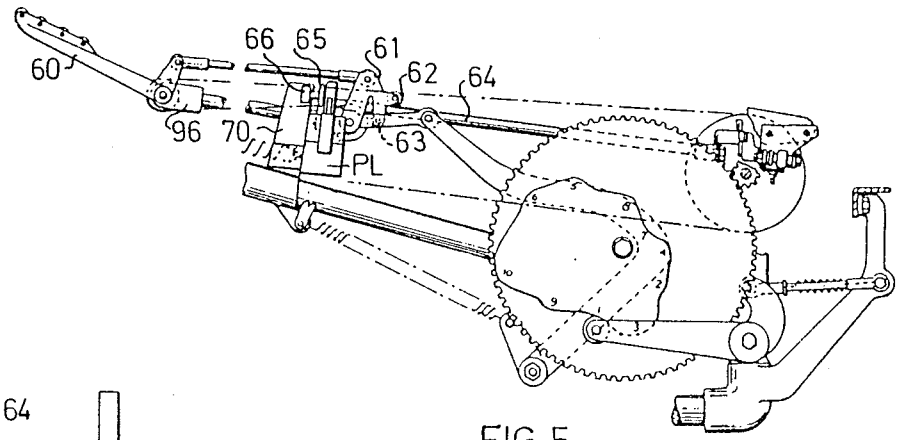
Figure 6:
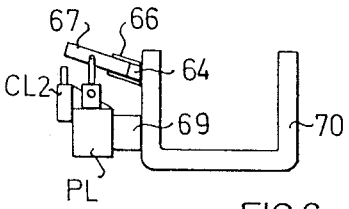
Figure 7:
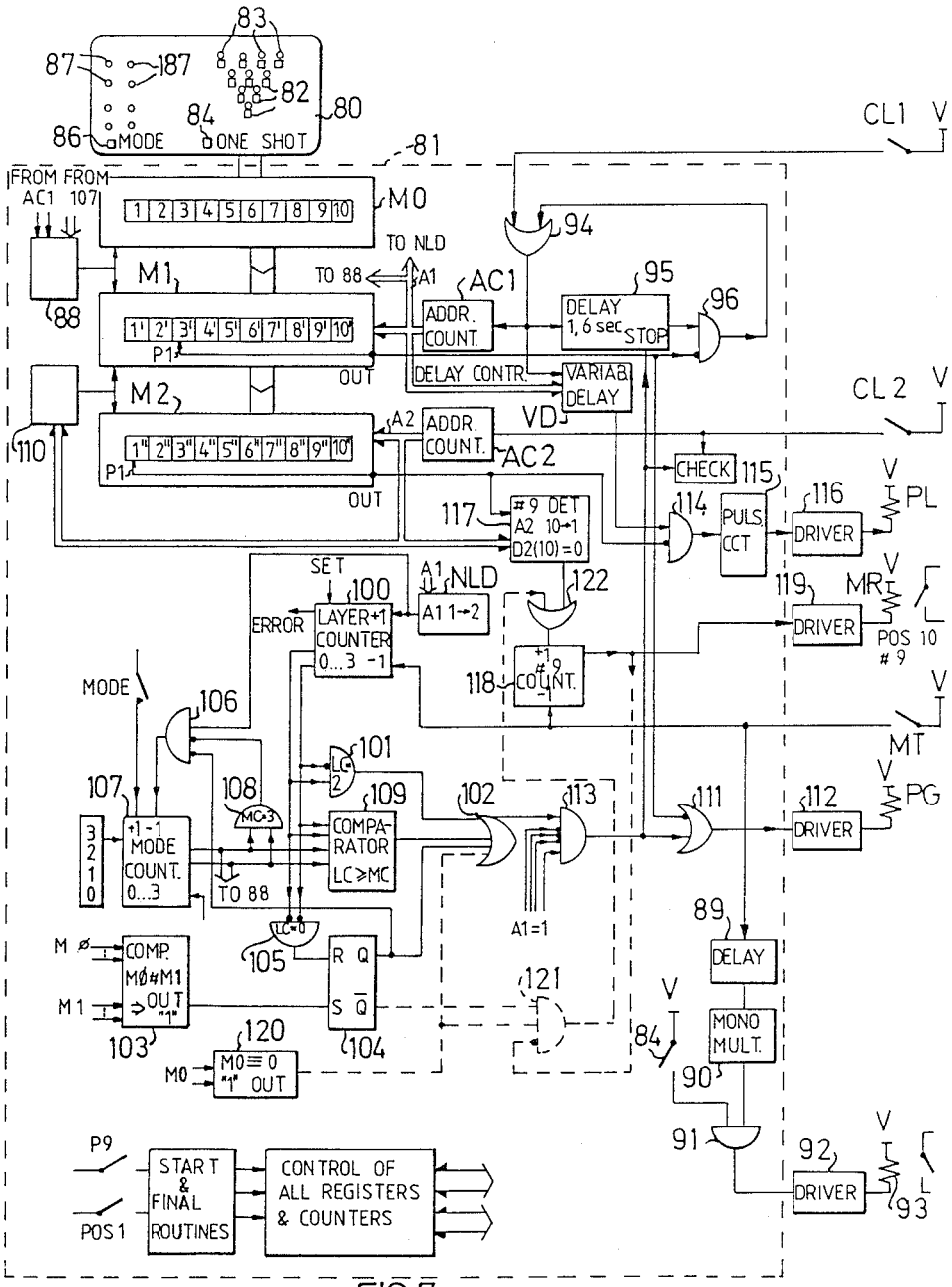

Other objects and advantages will become readily apparent from the following detailed description taken in connection with the accompanying drawings, in which FIG. 1 is a diagrammatic view of a pin setting machine by Brunswick Corporation showing the locations of the operating and sensing elements according to the invention, FIG. 2 is a block diagram of the control device in accordance with the invention operating on the Brunswick Corporation machine, FIGS. 3 to 6 are different views of a pin setting machine by American Machine & Foundary Corporation (AMF), showing the locations of the operating and sensing elements provided according to the invention, and FIG. 7 is a block diagram of an embodiment of the control device in accordance with the invention operating on the AMF pin setting machine.

FIG. 1 shows a schematic representation of an automatic pin setting machine of the Brunswick Corporation design. Sensors and operating devices provided in accordance with the invention are shown schematically in their preferred locations but in greater scale than they have in reality for the sake of clearness. A thorough description of this machine is given in Automatic Pinsetter Service Manual of the Brunswick Bowling Service Department 12-752828, Muskegon, Michigan, and in the U.S. Pat. No 2,949,300.

A cross conveyor 1 carries the pins 2 from a pin elevator (not shown) to a turret 3. A pair of parallel moving belts carry the pins 2 to deposit them one at a time into the turret 3. A blocking device designed as a pin gate 4 near the top of the conveyor 1 prevents a second pin on the conveyor from being delivered to the turret, until the turret has rotated to a new position after receiving a pin. The pin gate being substantially a bent band of a resilient material fixed at 5 in its upper part, having a part extending upwardly between the conveyor belts (not shown) and having its lower part connected to a tension spring 6 drawing it to its upwardly extending position.

When a pin is permitted to pass, a so-called pin gate latch 7 has its locking arm placed in a non-locking position. When the pin passes the gate, the gate will be urged in a downward direction against the action of the spring 6 by the heavy pin. This will cause the pin gate latch 7 to come into a locking position to lock the gate 4 to prevent the next pin from being delivered to the turret.

In order to show details located behind the turret, only a part of its turret basket assembly 8 is shown at the right side in the Figure. The turret basket assembly 8 consists of nine framework pin baskets and has a central chute 9 for the tenth pin, which is the central pin in a complete pin setting, i.e. the chute 9 is the so-called No 5 pin chute. The turret is constantly driven via a friction clutch (not shown) and stopped by a stop lever control 10 at each rotational location appropriate for the delivery of a pin in a framework basket.

The stop lever control 10 is in turn controlled by a turret indexing cam 11 having ten lobes and ten depressions. The stop lever comes to a turret locking rest each time a depression of the.turret indexing cam 11 is located in front of it. It is released to permit the turret to rotate by a lever arm 12 connected to an indexing trip lever 13, when it is pivoted in the clockwise direction by a pin falling down into a basket.

This releases the stop lever control 12 from locking the turret. The turret is free to rotate one step until a new depression is placed in front of the stop lever control 12.

In reaching a new depression, the stop lever control 12 causes a pin gate latch link 14 to move upwardly. A nose 15 at the upper end of the link 14 engages a shoulder in the pin gate latch 7 and lifts the latch up, thus releasing the pin gate to be free to be pressed down by next pin on the conveyor 1.

The operation above takes place for nine pins sequentially to be placed in a respective basket in the turret basket assembly 8. For the tenth pin, the No 5 chute 9 comes into place to receive it. In FIG. 1 the No 5 chute 9 is not shown in its pin receiving position in dashed lines. At its lower part a pin release lever arrangement 16 is placed. This arrangement 16 is intended to be operated by the tenth pin. The tenth pin is used to trigger the release of the ten pins now placed in the turret through deck chutes 17*a* into the so-called scissors deck 17.

The deck 17 moves up and down during the operation of the pin setting machine. The release of the pins from the turret 3 to the deck 17 can only be effected when the deck is in its uppermost position. Therefore, interlock blocking fingers (not shown) are provided in order to lock the pin release lever when the deck 17 is not in its uppermost position.

Briefly, this pin setter machine normally operates in accordance with the following pin setter operation: placing ten pins provided in the scissors deck 17 on the bowling lane (not shown), lowering the scissors deck 17 to examine the number of pins still standing after the first ball has been thrown, lifting up the remaining standing pins with the scissors deck, raking away pins knocked down with a rake (not shown), replacing the remaining uplifted pins on the bowling lane, lowering the scissors deck anew after the second ball is thrown to count the remaining standing pins and raking all the remaining pins away. If a strike is made, and the first lowering of the scissors deck reveals that all the pins have been knocked down, then the machine jumps over the rest of the operation cycle steps and prepares to place a new pin setting on the lane.

The description above is of the well known Brunswick pin setting machine that is common on the market, and it is therefore not discussed in greater detail.

In accordance with the invention, the following controllable operating units and sensors are provided and shown in their preferred locations. However, other locations for these elements can be selected than those shown in FIG. 1. Three pushing solenoids PG, PL and TR, which extend a plug when activated by a current feed through their coil, are provided.

The first pushing solenoid PG is placed at the lower part of the pin gate 4. When activated, it has a locking action on the pin gate 4 even if its pin gate latch 7 is in a releasing position.

The indexing trip lever 13 has a protruding belt 19 a distance from the pivot 18. The second solenoid PL operates on this bolt 19 when activated, thus causing the lever 13 to rotate and thus simulate the movement normally caused by delivery of a pin.

The third solenoid TR is placed at the pin release lever 16 to push on a lever 16' linked with it to simulate the movement caused by a pin provided in the No 5 chute.

A fourth unit OS of the solenoid type, such as a relay, is not shown in FIG. 1 but is placed in the control device for the machine operation cycle in order to make it jump over the first cycle part including the first setting and counting operation and to go directly to the part of the cycle when the rest of the pins are placed from the scissors deck 17 to the lane 18.

The third solenoid TR is placed on the rotating turret 3. In order to be able to feed the activating current to its coil at control, a slip ring arrangement 20 is provided at the top of the turret. A slip ring arrangement is a well-known arrangement and it is therefore only shown schematically.

Two sensors in the form of microswitches are provided. The first microswitch PGL is placed at the pin gate link 14 and is activated each time it is moved upwardly. The turret 3 is provided with a protruding arm 21 rotating with the turret and for instance provided at the top of the turret basket arrangement 8. The second microswitch TCR is stationarily located so as to be activated by the arm 21 when the turret comes out of its position to receive the ninth pin but before it reaches its position to receive the tenth pin in the No 5 chute. It is alternatively possible to have this activation of the microswitch made when the turret comes in the position for the delivery of the first pin. However, the control circuit described below will in this case have a slightly different operation in that it must use a counting operation to count the signals from the switch PGL from the start to operate on the solenoid TR instead of an input signal from the switch TCR.

FIG. 2 shows an embodiment of the control device to control the machine in accordance with the invention. A panel 22 conveniently situated for access at the bowler's end of the alley contains switches 23, which each one for instance can be of the push-button or the toggle type, having a built-in lighting or a separate light in the vicinity of the switch lighted at operation or can be of the toggle type having a lever control or the like. There is one switch per pin in a full pin setting. The switches 23 are suitably provided in the same pattern as a full pin setting. The player can set a desired spare training pin set by operating the switches for chosen pins to be in an ON-position and the rest to be in an OFF-position.

The panel 22 has also other operable switches 24 to 27 for the control of the play by the player.

When the switch 24, called ONE SHOT, is operated, the fourth pulling electromagnet OS mentioned above is constantly activated, thus imparting to the pin setting machine an operating cycle having only a one-ball game instead of providing the normal two-ball game. The ONE SHOT switch operation is made by the control circuit 30 via the drive circuit 36. It is also possible to have this ONE SHOT function automatically provided as soon as a player wants to use the spare training possibility, which is indicated for instance when a knob 31 on the panel is switched on.

A spare combination, whether it is the first one after the supplemental devicehas been turned on or a new combination following an earlier combination, can be recorded in a first register 28, called the panel register, when the player operates one of the switches 23 or the HOLD switch 25. The function of the panel register 28 will be described in more detail below. This operation of a switch will turn on a so-called HOLD function. When this HOLD function is on, the control circuit will control the turret 3 to proceed with its current pin filling cycle and to stop to rest at the start position to receive a new set of pins with the pin gate 4 closed or blocked. If the turret 3 happens to be upon start position at the operation of one of the switches, 23 or the HOLD switch 25, it remains in this position.

When the player has programed the desired spare combination, he operates either the HOLD switch 25 to have only a single spare combination filled in the turret and then to come to rest anew at the start position or the SPARE REPEAT switch 26 to have the turret filled with the new combination each time a game has been played, i.e. to cause the pin setting machine to repeatedly fill the chosen combination in the turret controlled only by the operation cycle of the machine, which in turn is controlled in the ordinary way by the throwing of the bowling ball.

It is to be noted that if the player manages to select a new combination and operate the HOLD switch 25 or the REPEAT SPARE switch 26 current before the filling cycle is complete, then the turret will not come to rest at the start position but the machine will start directly to fill in the new spare combination in a new filling cycle when next it reaches the start position.

The operation of the RAKE switch 27 causes the machine to rake away a pin setting placed on the lane directly without a ball being thrown.

One substantial advantage of the invention in relation to existing spare training devices is that the player is able to make the spare setting operation on the switches 23 directly for activating the control device to receive a new spare combination. This is achieved by having two registers, of which the first register 28, i.e. the panel register mentioned above, is connected to the panel 22 to directly receive a spare combination programmed on the switches 23, and the second register 29 is a control register used by a control circuit 30 for the actual control of the pin setting machine. In accordance with the invention, the control circuit 30 transmits the content of the panel register 28 at a control operation from the control circuit 30 only when the turret is at or is just arriving at the position to receive the first pin in a pin cycle filling operation. In this way the player is not bound to wait until the machine has finished its actual filling until he or she is allowed to operate the switches 23, such as is described by Conklin et al in U.S. Pat. No 3,314,676.

The control circuit 30 is preferably a computer, for instance a microcomputer of any of the standard types on the market provided with a program working in accordance with the functional order given below. However, the control circuit may as well be a hardware circuit controlled by the control register 29, which latter may in turn be a shift register having a parallel input and a serial output or the like. The operation of the control circuit 30 is the following:

A. At the start, when the player has turned on the supplemental device by turning the knob 31 in its ON position or directly after the power is provided anew after the occurrence of a loss of off-site power, both the control register 29 and the panel register 28 are for instance filled with "0":s. The HOLD function is automatically set on. This is indicated on the panel by lightening the HOLD switch if this kind of switch is provided or by turning on a separate HOLD light (not shown). This control is made via the data cable 32 from the control circuit 30 to the panel 22.

The setting of "0" in the control register 29 prevents the rest of the turret baskets in the current filling operation from being filled with pins.

Alternatively, the control register 29 is set at "1", which causes the rest of the turret baskets in the current filling operation to be filled with pins.

B. The machine proceeds with the current turret filling operation going on, until the start filling position is reached. During this time the player can program a desired spare combination with the switches 23. This combination is stored in the panel register 28.

C. During the turret filling operation going on when the switch 31 was turned on, the content in the scissors deck 17, representing the turret filling before the current filling is placed on the lane. When the turret is filled, its content cannot be transmitted to the scissors deck 17 until the set on the lane is raked away. The release of the pin release lever 16 is prevented by the interlock blocking fingers mentioned above until, the lane is free from pins. Thus, when the player sets his spare combination, he or she has two pin settings to get rid of before his spare combination comes to the lane. The player can either play the game on the lane in the ordinary way or choose to rake it away by operating the RAKE switch 27. In the first case the control circuit 30 just waits and in the second case it transmits a RAKE signal to operate the rake (not shown). A rake control of this kind is conventional and is thus not described in detail.

D. When the turret has come into position to receive the No 5 pin in the chute 9, the switch TCR is activated. This indicates to the control circuit 30 that the last position is reached and that a counter arrangement for counting the turret filling shall be reset at the next activation of the switch PGL, i.e. the next time the pin gate latch link 14 is raised.

E. When the pins on the lane are raked away, the pin release lever 16 is released, causing the content of the turret to be transferred to the scissors deck 17, the releasing of the turret indexing cam, the emptied turret to move to its start position,the pin gate latch link 14 to raise, and the switch PGL to be activated.

F. The turret now being in the start position to receive the programmed spare combination, the control circuit 30 transmits the content in the register 28 into the control register 29. The filling control of the turret is made in accordance with the content in the register 29 in the following way, the content being placed in the register 29 in the order in which the pins are to be filled in the turret baskets.

Every new filling cycle for delivering one pin in one of the baskets begins with an activation of the switch PGL. The cells in the register 29 are read in sequence, starting with the first cell for the filling of the first pin. The advancing of the register reading may be done by a counting operation advanced each time an activating signal from the switch PGL is provided to the control circuit 30 and reset by a signal from the switch PGL coming after an activating signal from the switch TCR. If the register is a shift register, then the register is clocked by the PGL-signal.

(a) If the content in the cell is a "1", i.e. a pin is to be filled, then the control circuit 30 just waits for the next PGL-signal to come.

(b) If the content in the cell is a "0" and no TCR-signal is provided, then the control circuit 30 first activates a drive circuit 33, which feeds an activating current through the coil of the solenoid PG. This will lock the pin gate 4 to prevent the next pin to be delivered to the turret. After a predetermined delay of the time it normally takes for the pin to pass from the pin gate to the indexing trip lever 13, in the order of 0.5 sec, the control circuit 30 activates a driver circuit 34, which in turn feeds activating current through the coil of the solenoid PL, which simulates the action of a falling pin.

(c) If the content of the cell is a "0" and a TCR-signal is provided, then the control circuit 30 first activates the driver 33 to activate the solenoid PG. After the predetermined delay the control circuit 30 then activates a driver circuit 35. The driver circuit in turn activates the solenoid TR. Since the interlock blocking fingers (not shown) may be blocking an outgoing movement of the pushing solenoid TR, this activating may be made in the form of pulses in order not to stress the solenoid TR. As an alternative operation to this pulsation, the upper position of the deck 17 can be sensed by a sensor (not shown) and the control circuit 30 makes an activation of the solenoid TR only when the upper position is sensed.

As mentioned previously, the player can choose to either activate the HOLD switch 25 again after the spare selection operation via switches 23 or to activate the REPEAT SPARE switch 26. In the first case the turret stops at the start position after the filling of the chosen pin combination. In the second case the pin combination is filled repeatedly play after play. When the player wants a new combination, he just activates one of the switches 23 or the HOLD switch 25, causing the turret to stop next time it reaches the start position.

It is to be understood that after the raking away of the first pin setting placed on the lane under the circumstances mentioned above, also the next pin setting placed on the lane is not a chosen one. This can naturally be raked away too by activating the RAKE switch 27. Then the first chosen spare combination is in its turn to be placed on the lane. It is to be noted that the raking down of the two pin settings before the spare combination can be set on the lane, can be done automatically by the control circuit 30 by signalling on the RAKE line.

The games to be payed for are usually counted by the machine by counting each game sequence. Since each game in spare training only contains one-ball games instead of the ordinary two-ball games and the player has to rake down two plays at the beginning of a training, the payment ordinarily counted for these game sequences can be compensated for by having a certain deduction of the price for each game, for instance half the price, and a whole deduction of the price for the games just raked away. The control device 30 can make this deduction and show an accumulated deduction price on the panel in a window 36, and possibly also transmit it to the central service desk for the supervising personnel.

Figure 3:
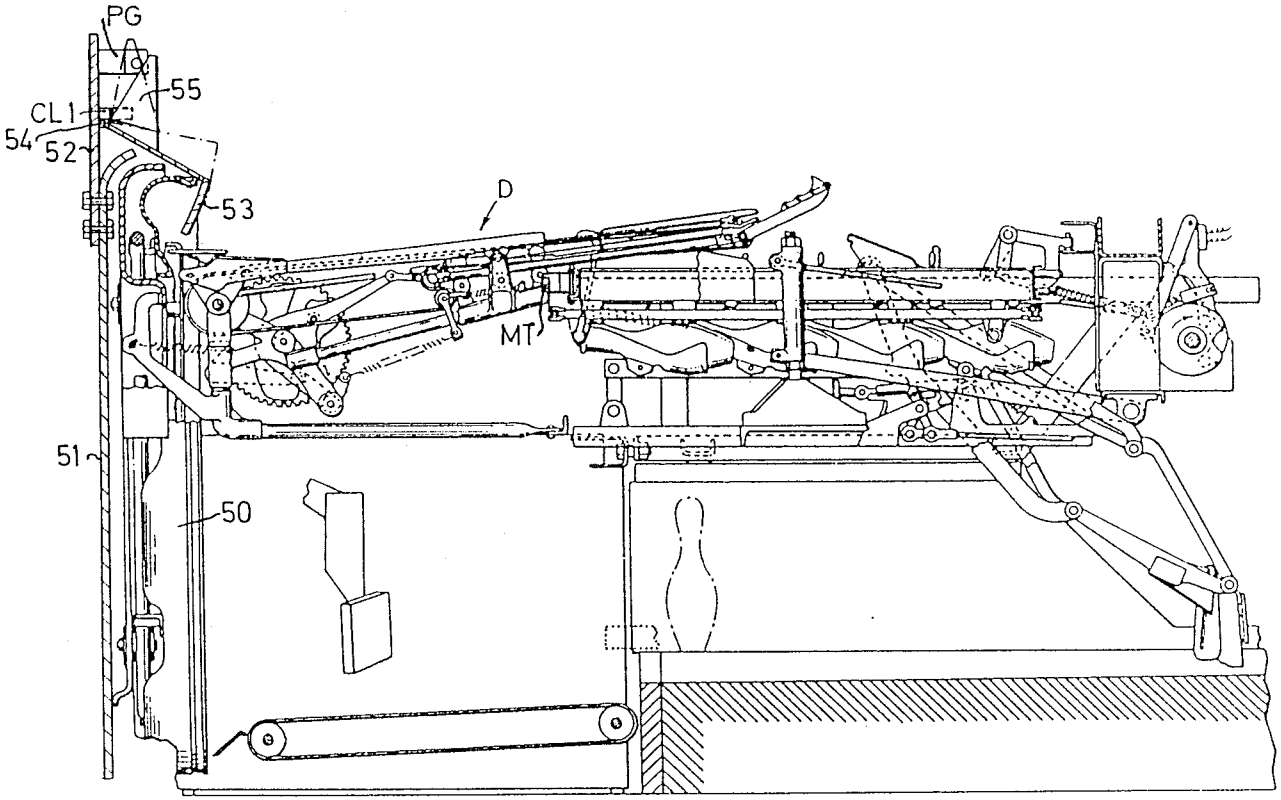
Figure 4:
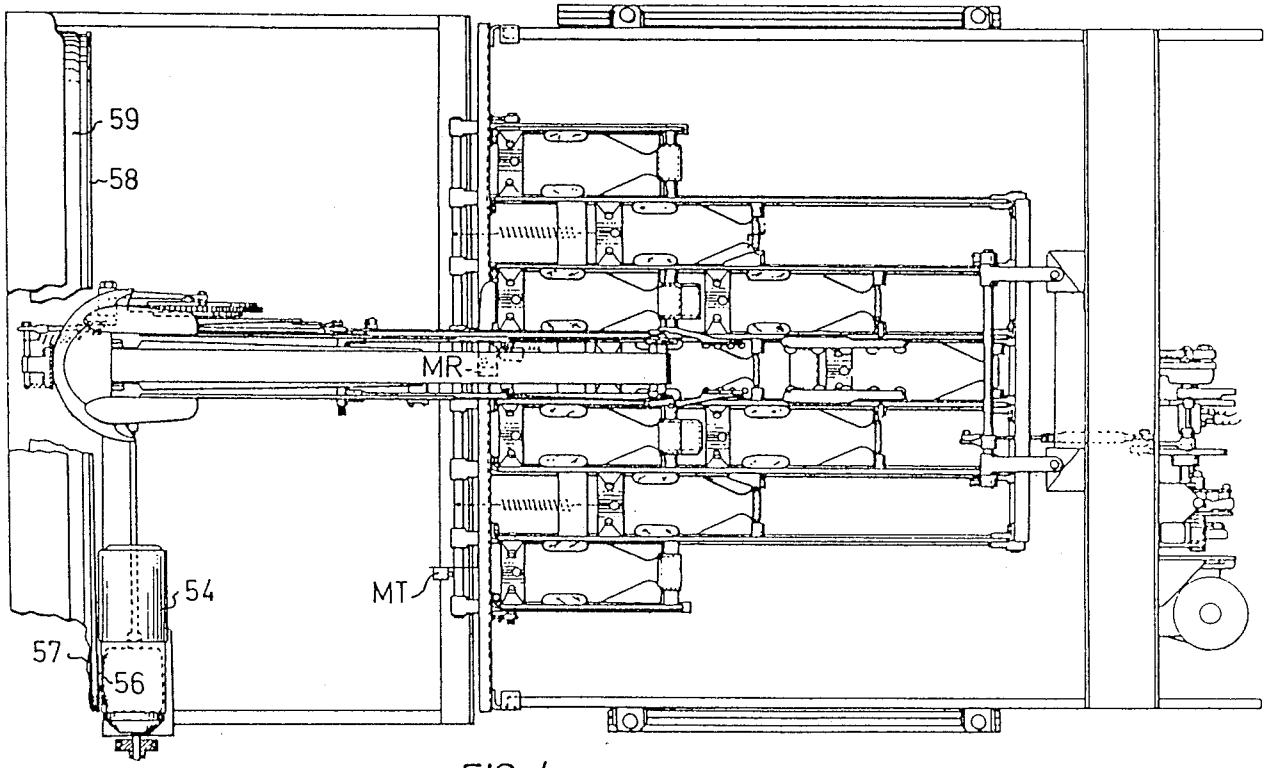

The supplemental device according to the invention can be provided on other pin handling devices than the one made by Brunswick Corporation of Chicago, Illinois. A pin handling device made by American Machine & Foundary Corporation of Philadelphia (below called the AMF Machine) is shown and described in detail by J Zuercher, Mansfield, Ohio in the U.S. Pat. No. 3,526,401 and gives a detailed and true description of a machine common on the market. The disclosure of the U.S. Pat. No. 3,526,401 is incorporated herein by reference. FIGS. 3, 4 and 5 of the present application correspond to FIGS. 1, 2 and 5, respectively, of U.S. Pat. No. 3,526,401 except that the reference numerals are taken away. FIG. 6 is a view perpendicular to the view in FIG. 5 and shows only the details of the machine having a function in the present invention.

The operation and sensing elements needed to make the pin setting device to work at the control of the device according to the invention are shown in FIGS. 3 to 6 and in the text below reference is made to the description of U.S. Pat. No. 3,526,401. Reference numerals are only given on elements in the well known device directly cooperating with the operational and sensing elements provided according to the invention.

Referring to FIGS. 3 to 6, a brief description of the elevating conveyor 50 is given in column 3, lines 55 to 63 of U.S. Pat. No. 3,526,401. As can be seen in FIG. 3, a protective shield 51 is always provided at the rear side of the machine. At the upper part of it a support 52 is provided, for instance with a bolted joint.

An arched door 53, also called the pin gate, is pivotally attached to hinges 54 on the support 52. The door 53 is provided with an upwardly extending, substantially triangular arm 55. The pin gate door 53 can be lifted up by a pin to be delivered to the distributor D. The position of the door 53 in this delivering position is shown with dashed lines.

A pushing type solenoid PG is mounted on the support 52. It is provided on the support such that the rear edge of the arm 55 is free to move to be placed close to the support 52, such as shown by the dashed line, when the solenoid is not excited. However, when the solenoid PG is excited and its core is pushed out, the core prevents the rear edge of the arm 57 from moving. This will hold down the door in the closed position, which will prevent the delivery of a pin on the rotating elevating conveyor 50 to the distributor D. Instead the pin will pass past the entrance to the distributor and proceed to rotate with the conveyor, supported by a stationary rail (not shown) preventing the pins from falling out of the conveyor after the passage of the pin gate.

A microswitch CL1 is also provided on the support in the vicinity of the door 53 but at the side of the moving path of the arm 55.

The switch CL1 is activated by the door 53 when it is lifted by a pin lifted by the conveyor 50, which happens when the pin comes in front of the distributor D to be delivered thereto and the solenoid PG is not excited. If the solenoid is excited, it prevents the pin gate door 53 from being opened by the pin. Then the switch CL1 is not operated.

From column 3, line 64 to column 7, line 47 in U.S. Pat. No. 3,526,401 the design and operation of the distributor D are described. In column 5, lines 42 to 74 the design and movement patterns of the arm 60, the trip lever 61, the spaced rollers 62,63, the rod 64, the lever 65 and the lug 66 mounted on the rear standard 70 are described.

In accordance with the invention the downward swinging of the arm 60 normally caused by a pin is going to be simulated. Each downward swinging of the arm 60 must be sensed by a sensor. A solenoid and a sensor could be provided directly at the arm 60. However, these elements should run the risk to be damaged in this position. Therefore, the movement of the link arm system connected to the arm 60 is influenced and sensed in the vicinity of the trip lever 61. This is shown in FIGS. 4, 5 and 6.

An arm 67 is fixedly mounted on the trip rod lever 65. One end of the arm 67 is mounted on the rod 64 in the vicinity of the lug 66. When the rod makes its upgoing movement, the outer end of the arm 67 will go down. A solenoid PL of the pulling type is mounted on a socket 69 mounted on the rear standard 70. The outer end of the solenoid core is attached to the outer end of the arm 67 near its end and pulls this end of the arm downwards, thus raising the trip rod 64, when it is excited. A microswitch CL2 is mounted on the solenoid 68 and is closed by the arm 67 when its outer end has moved down.

The switch CL2 is activated every time the distributor D shall be moved to another position to deliver a new pin in a new storage bin, i.e. it is activated when the trip rod is moved up, caused either by the rotation of the arm 60 or of the solenoid PL when it is excited.

The function of the magazine 72 is described from column 7, line 48 to column 9, line 36. The delivery of the No 9 pin is described in column 9, lines 23 to 36 of U.S. Pat. No. 3,526,401.

According to the invention, the delivery of the No 9 pin must be simulated, if this pin is not chosen by the player in setting his spare combination. Therefore, as shown in FIG. 4, the action of the switch 73 must be simulated. In order to make this simulation, a relay MR is seated in the vicinity of the switch 73, for instance glued directly on it. The contact parts of the normally open contact of the relay 74 are connected to each of the electrical leads of the microswitch 73.

The relay MR is intended to simulate a pin delivery of the No 9 pin in the position No 10 in the magazine by closing its contact P9.

The shuttle is described from column 9, line 36 to column 10, line 70 in U.S. Pat. No. 3,526,401.

A microswitch MT to detect this return may be seated on many alternative locations, of which one is shown in FIGS. 3 and 4. A support 75 is provided on the cross channel 76 of the magazine. A microswitch MT is mounted on the support 75 at such height to be operated hy the backwardly going movement of the shuttle, when the magazine discharge operation is completed.

The switch MT indicates that the magazine has been successfully loaded with one layer of pins.

FIG. 7 shows an embodiment of the control device to control the AMF pin setting machine shown in U.S. Pat. No. 3,526,401 and in FIGS. 3 to 6. FIG. 7 is a schematically drawn block diagram. However, it is to be noted that a control diagram of the kind shown in FIG. 2 may be provided instead, i.e. a control having a panel register and only one control register may be provided, and a delay circuit can be provided instead of having a second control register as described below.

In FIG. 7 a control panel 80 cooperates with a control circuit 81. A schematically drawn block diagram is drawn in the dashed block 81 and illustrates the operational steps made by the control circuit 81. The circuit 81 includes most conveniently a microprocessor provided with a data program even though the functions of the circuit are illustrated by hardware elements and Boolean functions in order to make its function easy to follow and to understand. The circuit 81 can naturally also be made as a hardware circuit.

The control panel 80 has ten buttons 82 in pin formation, each button having an indicator 83, such as a light emitting diode or a lamp, located in or above the button. The pin number is shown either on or near the button.

The buttons are of the momentary type, having "toggling" action on the indicators contained by the program. The ONE SHOT button 84 also provided on the panel has an indicator 85 to the right of the button. The HOLD, SINGLE SPARE and REPEAT SPARE functions as well as a new function, DOUBLE SPARE, in relation to the one shown in FIG. 2, are provided but operated to be stepped in force one at a time in a sequential cyclical manner by depression of a single button 86 called MODE. One light indicator 87, such as a lighte-mitting diode or a lamp, is provided for each function and the indicator indicating the actual function is lighted. Four functions are provided:

HOLD: The internal magazine loading will stop after the current loading cycle has been completed;

SINGLE SPARE: When the chosen pin setting has been delivered once into the magazine, the mode HOLD is automatically set. Only one layer in the magazine is filled;

DOUBLE SPARE: When the chosen setting has been delivered to the magazine, the mode SINGLE SPARE is automatically set, and after a new delivery to the magazine, the mode HOLD. A total of two layers are filled in the magazine.

REPETITIVE SPARE: When the chosen setting is continuously loaded in the magazine, the magazine is continuously loaded after each play. Naturally the number of layers in the magazine at each time is limited to two.

Every automatic change of the magazine status is indicated on the panel 80, either by having this mode change indicated by having a separate column of indicators 187 or by having some flickering indication on the indicators 87 or in any other suitable way.

When the ONE SHOT button 84 on the panel is operated, its normally open contact is closed. This contact is also shown down to the right in FIG. 7. The switch MT is in one path connected in series with a delay unit 89 and a monostable multivibrator 90 activated by the flank of the signal from the unit 89. The contact 84 is connected to one input of an AND gate 91. The output of the multivibrator 90 is connected to the other input of the AND gate 91, which output is connected to a drive circuit 92, which activates the coil of a relay 93. Thus, when the ONE SHOT button 84 is operated by a player, a pulse is given to the drive circuit 97 every time new pins are placed on the lane. The closing of the contact of the relay 93 steps the ordinary AMF control unit to the "second ball cycle", such that the pins are raked and replaced after each ball. When the button 84 is not operated, then of course the normal two-ball game is provided.

A problem inherent in the spare setting control of the AMF machine is that it takes approximately three seconds for pin No 1 to travel from the pin gate at the door 53 to the trip arm 60. The machine whould be very slow if the pins had to be delivered from the pin gate door 53 to the arm 60 one at a time, i.e. had to wait for each other. The normal operation of the machine is to have the pins coming very closely after each other such that the distributor D contains several pins in a row.

In order to make the operation as fast as possible, two control registers M1 and M2 are used, of which the register M1 is synchronized with the function of the switch CL1 and the solenoid PG, and the register M2 is synchronized with the function of the switch CL2 and the solenoid PL. As in the embodiment shown in FIG. 2, a register M0 is provided to be filled with data corresponding to the spare combination programmed by the player via operating the buttons 82 at the moment of acting on them.

The registers M0, M1 and M2 are ten-bit registers. A "1" in the registers corresponds to a pin to be set, and a "0" indicates the absence of a pin, i.e. that a pin setting must be simulated for the ordinary control system of the machine. The bit positions in the registers correspond to the pins in the order in which the pins are delivered to the magazine. This order corresponds naturally also to the order in which they are handled by the conveyor 50. This pin order is No 1, No 3, No 2, No 4, No 7, No 8, No 5, No 6, No 10, and finally No 9 in the AMF machine.

The switch CL1 is connected in series with one input of an OR gate 94, the output of which is connected to an address counter AC1 for the register M1. Thus, every pin that operates the pin gate door 53 during transfer to the distributor D will cause an incrementation of the counter AC1. When the pin gate door is closed, the switch CL1 is not operated. Therefore, a signal simulating a pin transfer will be provided when a pin is to be omitted from the spare setting. In order to provide this simulation, a delay circuit 95 is connected to the output of the OR gate 94. This delay circuit will feed a pulse on its output a predetermined time, for instance 1.6 sec, after each pulse from the OR gate 94 to a non-inverted input or an AND gate 96. The output of the register M1 is connected to an inverted input of the AND gate 96. The output of the gate 96 is connected as the signal to the other input of the OR gate 94, and the simulating signal will be provided only when a "0" is provided in the register cell to which the register was advanced by the last increment signal from the address counter AC1. In this way both the real and the simulated pins will increment the register M1 in the sequential order.

The magazine of the AMF machine has two layers, which are not separated. Therefore, a pin filled in one of the pin positions will always fall to the lower layer if a pin is not there. Therefore, the whole magazine must be empty when a new spare combination is to be filled after an earlier spare combination, otherwise a pin jam between the earlier combination and the new one will be the result.

A transfer from the register M0 to the register M1 is preferably done each time the binary address output A1 of the address counter AC1 has the number 1. However, when a new pin setting combination is to be set or is just set, the transfer shall not be made until the player has confirmed his setting by operating the mode button 86. Therefore, a MODE counter 107 is provided, which is set to the count 0, representing the mode HOLD, as soon as anyone of the buttons 82 is operated. The count in the MODE counter is then stepped forward at each pushing of the MODE button 86. The count is provided on a digital output of the counter 107.

The output signal A1 of the address counter AC1 is fed to a first input of a transfer control circuit 88. The output signal of the MODE counter is fed to a second input of the circuit 88, which output is connected to a transfer control input of both the registers M0 and M1. When the signal A1 goes to the number 1, then a transfer signal is provided directly if the MODE counter output signal is not 0. However, if the MODE counter output signal is 0, the transfer signal is inhibited till this signal changes to 1.

When the internal HOLD function, described in detail below, is in force, the machine will stop at the start of filling a new filling sequence in order to prevent mixed settings.

When the player changes his setting, i.e. the content of the register M0 will be different from the content of the register M1, the HOLD signal is "1" until the magazine is emptied. Therefore, the control circuit has a counter 100, which is incremented at each filling of the magazine and incremented at each delivery of a pin layer of the magazine to the lane.

The counter counts from 0 to 3. When the count is 0, there are no pins in the magazine. When the count is 1, there are pins in one layer only in the magazine. When the count is 2, there are two layers of pins in the magazine, i.e. the magazine is full. When the count is 3, there is an error, which is noticed by a circuitry for check, start and final routines; this is not described and shown because it has no actual part of the invention. This circuit contains the contacts P9 and Pos 1 shown down to the left. Closing of the contact Pos 1 indicates that the belt conveyor arm is in its No 1 position, i.e. at the position to deliver the pin No 1. The contacts P9 and Pos 1 are contacts provided parallel to contacts in the ordinary control system of the machine, and control of them is done after a possible main power interrupt and for error correction purposes. The start and final routines are rather time-consuming. Therefore, the control device of the AMF machine is to be constantly in operational state in normal operation.

In order to increment the counter 100, the output A1 of the address counter AC1 is fed to the input of a circuit NLD, which feeds a "1" signal to the counter incrementing input each time the A1 signal goes from 1 to 2, indicating that the first pin (No 1) of the filling sequence has just passed the pin gate. The counter 100 is decremented by the MT signal.

When the spare setting possibility is activated, the count in the counter 100 is set to 2. If the player operates the MODE button 86 to other than the HOLD function, a hold release operation will be started. In this operation the internal HOLD function will proceed inside the control device 81 until the count in the counter has been decremented down to 0, indicating that there are no layers in the magazine. Therefore, the digital output is connected to the inverted and the non-inverted input of an AND gate 101, which has a "1" signal on its output when the digital output of the counter 100 is 2. The output is connected to a first input of an OR gate 102.

The contents in the registers M0 and M1 are compared in a comparator 103. When the contents of M0 and M1 are not the same, a "1" signal is provided at the output of the comparator 103. This signal is fed to a set input of a flip-flop 104 of the SR-type. The Q output of the flip-flop 104 is connected to a second input of the OR gate 102. In this way the HOLD signal is provided as soon as a new spare setting is complete. In order to prevent pin jam, the magazine must be emptied. Therefore, the digital output of the layer counter 100 is connected to the two non-inverted inputs of an AND gate 105, which feeds a "1" signal to the reset input of the flip-flop 104. In this way the flip-flop is not reset until the counter 100 has counted down to 0.

The Q output of the flip-flop 104 is also connected to an inverted input of an AND gate 106. The MODE counter 107 is controlled by operation of the MODE button 86. When the modes DOUBLE SPARE and SINGLE SPARE are in operation, the MODE counter shall be decremented down to the HOLD function. When the mode REPEAT SPARE IS OPERATED, no decrementation shall take place. In the MODE counter 107 REPEAT SPARE is represented by the count 3, DOUBLE SPARE by 2, SINGLE SPARE by 1 and HOLD by 0. A decrementation is to be done each time a new layer begins to be filled. Therefore, the output signal of the new layer detector NLD is fed to a non-inverted input of the AND gate 106. In order to prevent decrementation when the mode count has the count 3, the digital output leads of the MODE counter 107 are connected to the non-inverted inputs of the AND gate 108, the output of which is connected to an inverted input of the AND gate 106. The output of the AND gate 106 is fed to the decrement input of the counter 107.

The digital output of the MODE counter 107 is connected to a first input of a comparator 109. The output of the layer counter 100 is connected to the second input of the comparator 109. When the count in the counter 100 is higher than or the same as the count in the counter 107, a "1" signal is provided at the comparator output and fed to a third input of the OR gate 102.

As mentioned above, in the AMF machine it takes a relatively long time for a pin just transferred from the pin gate to the distributor D to reach the arm 60 to be delivered in its position in the magazine. There are several pins already on the distributor to be delivered first. In order to take care of the particular problem caused by these condition, the second control register M2 is provided.

The second register M2 is controlled by an address counter AC2, which in turn is stepped forward by each closure of the switch CL2. The content of the register M1 is transferred to the register M2 each time the digital output A2 of the output of the address counter AC2 changes from 10 to 1. This is done by the transfer operating circuit 110. The output of the counter AC2 is fed t the input of the circuit 110.

The phase displacement between the registers M1 and M2 is illustrated by showing the address pointers P1 and P2, respectively, at different register cells. The solenoid PG at the door 53, also called the pin gate, is controlled by the register M1. The output of the register M1 is connected to an inverted input of an OR gate 111. Each time the register content in the cell, to which the address pointer P1 is pointing, has a "0", which is provided at the register output, the output of the OR gate feeds a "1" signal to a driver circuit 112, which in turn excites the solenoid to prevent the door from being opened by a passing pin.

The pin gate door 53 must also be closed when the HOLD function is in force and the register M1 has the pointer P1 at the cell 1'. Therefore, the HOLD signal from the output of the OR gate 102 is fed to a non-inverted input of an AND gate 113, the output of which is connected to a non-inverted input of the OR gate 111. The four-line digital output of the address counter AC1 is connected to two non-inverted and two inverted inputs of the AND gate 113 such that the AND gate feeds the output of the OR gate 102 to the non-inverted input of the OR gate 111 each time the signal A1 has the number 1. In order to stop further incrementation of the address counter AC1, the output of the AND gate 113 is connected to a STOP input of the delay circuit 95.

The output of the register M2 controls the position lock solenoid PL (placed at the trip rod lever 65) together with the signal A1 and the input signal to the counter AC1 in the following way. The output of the register M2 is fed to an inverted input of an AND gate 114. The input signal of the address counter AC1 is fed to a variable delay circuit VD. This signal is after a certain delay fed to a non-inverted input of the AND gate 114. The delay is dependent on the actual time it takes for a pin delivered to the distributor D to be delivered to the magazine. This time is different for each pin. The output of the address counter AC1 is therefore fed to a control input of the variable delay circuit VD. The delay circuit has a predetermined delay for each address.

The output of the AND gate 114 is connected to the input of a pulse circuit 115, which feeds a pulse to a driver circuit 116 to excite the solenoid PL each time a "1" signal is provided at the output of the AND gate 114.

The content in the cell 10'' in the register M2 is also used to control the magazine release relay MR. A No 9 detect circuit 117 has its input connected to the output of the register M2. The digital output A2 of the address counter AC2 is connected to a control input of the circuit 117. The circuit 117 operates in the following way: when the signal A2 has the number 10, the signal from M2 is stored. When the signal A2 changes to the number 1, the stored content is provided at the output of the circuit 117.

The output of the circuit 117 is fed to the increment input of a No 9 counter 118. The MT signal is fed to the decrement input of the counter 118. The counter 118 can count from 0 to 3. If the count is equal to or greater than 1, the output of the counter 118 is a "1" signal, which is fed to a driver circuit 119. The driver circuit 119 in turn excites the relay MR to close its contact.

The purpose of having the counter 118 in this configuration is to prevent the ordinary control system of the AMF machine from emptying the magazine when the magazine is in fact empty.

When all the register cells in the panel register M0 are filled with "0", it is preferred but not necessary to provide a HOLD function. In order to provide this possibility, the full output - ten output lines - of the register M0 is also connected to a zero detecting circuit 120, which may be an AND gate having ten inverted inputs. The output of the circuit is fed to a forth non-inverted input of the OR gate 102 and also to a non-inverted input of an AND gate 121. The inverted output $\overline{Q}$ of the flip-flop 104 is connected to a non-inverted input of the AND gate 121, such that a "1" signal is fed to the gate 121 when the flip-flop 104 is reset. The output of the counter 118 is connected to an inverted input of the AND gate 121. The output of the AND gate 121 is fed to a first input of an OR gate 122, which has the output of the circuit 117 on its other input and has its output connected to the counter 118. In this way the machine will stand by if the player has set a spare combination including no pins, and not start a new filling cycle attempting to fill the magazine only with simulated pins, but instead the No 9 counter will be incremented every time it reaches zero, in order to keep the magazine release and pin setting procedure in operation. In this way the "empty lane" practice condition can be achieved as quickly as possible.

While embodiments of the invention have been described in detail, it will be obvious to those skilled in the art that the invention may be embodied otherwise without departing from its spirit and scope.

We claim:

1. In an automatic pin handling machine having a pin magazine with at least one pin setting layer, a loading device for placing at least one layer of pins sequentially in said magazine in accordance with a predetermined loading pattern, means for discharging a said layer of pins from said magazine onto a bowling lane, and a control system for causing said machine to effect a predetermined repeating pin setting cycle responsive to at least one ball having been rolled by a player, the improvement in which said machine further comprises:

a control panel comprising player-actuated pin setting switches for selecting a desired pin setting combination fewer than a full pin setting so as to enable the player to designate the pattern of a selected spare;

blocking means to prevent pins not selected with said pin setting switches from being delivered to said magazine, said blocking means acting on said control system;

simulation means to simulate delivery of pins not selected with said pin setting switches to said magazine, said simulation means acting on said control system;

sensor means sensing each change in said predetermined repeating pin setting cycle;

a first memory store having at least one storage cell for each pin position in a full pin setting, said first memory store storing said desired pin setting combination selected with said pin setting switches, said first memory store being connected to said control system;

a second memory store containing storage cells corresponding to said storage cells in said first memory store and being connected to said control system;

and said control system further comprises means monitoring each stage of said predetermined repeating pin setting cycle reponsive to said sensor means and means controlling said blocking and simulating means responsive to data stored in said second memory store, and means transferring data stored in said first memory store to said second memory store only after a said predetermined repeating pin setting cycle had ended, and before commencement of a next said predetermined pin setting cycle.

2. Machine according to claim 1, wherein said control system further comprises a delay arrangement to provide a predetermined delay between control of said blocking means and said simulation means at each stage of a said pin setting cycle wherein data stored in said second memory store dictates that a corresponding pin is not to be loaded, said delay being a function of the time required for a pin to pass from said blocking means to said simulation means.

3. Machine according to claim 1 said magazine being adapted to hold at least two layers of pins, said control system emptying said magazine before starting a new said pin setting cycle responsive to a determination that data transferred to said second memory store prior to said new pin setting cycle is different than data stored therein during an immediately previous said pin setting cycle.

4. Machine according to claim 1, and a third memory store connected to said control system, said control system comprising means transferring data stored in said second memory store to said third memory store upon loading of a first pin of a said desired pin setting combination in said magazine, said control system including controls exerted to control said blocking means based on data in said second memory store and said simulation means based on data in said third memory store with a delay between the said controls exerted based on data in the second and the third memory stores corresponding to the time difference of pin passage from said blocking means to said simulation means.

5. Machine according to claim 1, wherein said control system comprises a hold function operable to control said control system to maintain said magazine completely unloaded and to block said pins by activating said blocking means, but not to activate said simulation means irrespective of the corresponding content of said second memory store after reaching the start position for a new said pin setting cycle.

6. Machine according to claim 5, wherein said hold function is actuated responsive to operation of any of said pin setting switches.

7. Machine according to claim 5, wherein at least one separate hold switch is provided on said control panel and is connected to said control system to activate said hold function responsive to actuation by a player of said hold switch.

8. Machine according to claim 5, wherein said control panel comprises at least one switch having a hold release function and said control system is adapted to operate independently of said control panel following activation of said hold release switch.

9. Machine according to claim 1, wherein said control system comprises a hold function operable to control said control system to maintain said magazine completely unloaded and to block said pins by activating said blocking means, but not to activate said simulation means irrespective of the corresponding content of said second memory store after reaching the start position for a new said pin setting cycle, and wherein said control panel comprises at least one switch having a hold release function, and said control system, responsive to operation of said hold release switch is adapted to compare the data in said second memory store for a new said pin setting cycle with data in said second memory store during the previous loading and to empty said magazine if there is a difference in these said data.

10. Machine according to claim 1, wherein said sensor means emits a signal to said control system upon arrival of said machine at a predetermined position in said pin setting cycle, said control arrangement being adapted to update its internal circuitry to correspond to said prdetermined position responsive to said signal from said sensor means.

* * * * *